United States Patent [19]

Kerby

[11] 4,177,117

[45] Dec. 4, 1979

[54] BIPOLAR REFINING OF LEAD

[75] Inventor: Robert C. Kerby, Rossland, Canada

[73] Assignee: Cominco Ltd., Vancouver, Canada

[21] Appl. No.: 910,947

[22] Filed: May 30, 1978

[30] Foreign Application Priority Data

Apr. 6, 1978 [CA] Canada ..... 300642

[51] Int. Cl.[2] ..... C25C 1/18

[52] U.S. Cl. ..... 204/114

[58] Field of Search ..... 204/117, 114

[56] References Cited

U.S. PATENT DOCUMENTS

| | | | |
|---|---|---|---|
| 2,664,393 | 12/1953 | Mathers et al. | 204/114 |
| 2,827,410 | 3/1958 | Smyers | 204/114 |

FOREIGN PATENT DOCUMENTS

| | | | |
|---|---|---|---|
| 988879 | 5/1976 | Canada | 204/114 |

*Primary Examiner*—R. L. Andrews

*Attorney, Agent, or Firm*—Wenderoth, Lind & Ponack

[57] ABSTRACT

A process for the electrorefining of lead from lead bullion using an aqueous electrolyte containing lead fluosilicate and hydrofluosilicic acid contained in an electrolytic cell, which comprises interposing in the cell between an anode and a cathode one or more electrically unconnected lead bullion bipolar electrodes, allowing electrolysis to proceed to deposit refined lead and recovering said refined lead.

38 Claims, No Drawings

BIPOLAR REFINING OF LEAD

BACKGROUND OF THE INVENTION

1. Field of the Invention

This invention relates to the electrorefining of lead and, more particularly, to bipolar refining of lead using a fluosilicic acid containing electrolyte.

2. Description of the Prior Art

Electrolytic refining of lead has been proposed using solutions of lead acetate, chloride or nitrate. In United States Pat. No. 209,056, Keith discloses a process for refining impure lead placed as anodes in an electrolyzing solution containing acetate, chloride or nitrate of lead, and made acid by means of either acetic or hydrochloric acid and depositing lead on cathodes. The insoluble impurities such as gold, silver and other metals are retained in muslin bags surrounding the circular anodes. The lead adheres to circular cathode plates in loose crystalline masses. Another early process for electrorefining lead is the Tommasi Process which is described in "The Metallurgy of Lead" by Henry F. Collins, London, Charles Griffin Co. Ltd., 1910, page 452, and which employs a series of disc cathodes revolving between anodes and half immersed in the electrolyte containing a double acetate of lead and potassium. The spongy lead is scraped off the cathode discs mechanically. Neither the Keith nor the Tommasi process proved satisfactory on a commercial scale because of the low output per tank and failure to produce regular deposits at higher current densities, in spite of some improvements obtained through the addition of glue or gelatin.

The first commercial electrolytic refining process for lead was that developed by Betts. This process, known as the Betts Process, is disclosed in U.S. Pat. Nos. 679,824, 713,277 and 713,278 and described in detail in the literature (e.g. see Collins, supra, pages 452–455 and A. G. Betts, "Lead Refining by Electrolysis", John Wiley & Sons, 1908). In the Betts Process, cast anodes of impure lead bullion and pure lead cathode starting sheets are placed in alternate fashion in electrolytic cells containing an aqueous electrolyte comprising hydrofluosilicic acid and lead fluosilicate. Anodes and cathodes are supported on contact bars connected to heavy copper bus bars which are in turn connected to a power source. During electrolysis, refined lead deposits on the cathodes and, while lead dissolves from the anodes, the impurities more noble than lead are left as metallic slimes adhering to the surface of the undissolved portion of the anodes. At the completion of the refining cycle, which may take from 3 to 14 days, the cathodes and anodes are removed from the cells. The cathodes are washed, melted, and cast into shapes for sale. The refined lead has a purity exceeding 99.99%. The wet slimes are separated from the undissolved portion of the anodes, washed to recover electrolyte and treated for the recovery of metal values. The undissolved anode bullion is remelted and recast into anodes. The Betts Process is generally operated at anode voltages not exceeding 0.2 V to avoid dissolution of bismuth, and at current densities in the range of 120 to 220 $A/m^2$ (amperes per square meter). Addition agents are used to ensure a level deposit of lead on the cathodes and avoid short-circuits between anodes and cathodes. But for relatively minor improvements, the Betts Process has been in use for over seventy years. It is presently the only commercial lead electrorefining process in the world.

Because of mostly economic pressures, it has become necessary to investigate mechanization and automation of the Betts Process. But, although certain improvements can be attained in the process using the multiple system with resultant increased efficiency of operation, the physical lay-out of the process with its separate casting and handling of anodes and cathodes does not particularly lend itself to major improvements. Indeed the structural weakness of the cathode starting sheets makes it difficult to accurately place them in the electrorefining cells.

SUMMARY OF THE INVENTION

It has now been found that bipolar refining of lead in a lead fluosilicate hydrofluosilicic acid electrolyte leads to major improvements resulting in major economic advantages over the conventional system of refining according to the Betts Process.

In bipolar refining, a number of lead bullion electrodes are placed in a cell together with an anode and a cathode (which may also be lead bullion electrodes) which are connected to an electrical power source. If all of the electrodes are lead bullion, then the first and the last electrodes act as a cathode and an anode respectively. Electrodes between the cathode and anode act as bipolar electrodes from which lead dissolves from the anodic sides and on which pure lead deposits on the cathodic sides.

Bipolar or series electrorefining of metals is not a new concept, and has been practiced commercially for copper, and proposed for zinc, and nickel. In spite of this, bipolar refining of lead has not been investigated hitherto. There appears to be only one reference to it in the literature, and that is a comment by Betts himself, writing before 1908, to the effect that bipolar refining of lead is not worth investigating. (Betts, op. cit. supra, pages 180–182). It seems that later workers in this field have taken this statement by the originator of the only commercial process for lead electrorefining presently in use at its face value and have not paid any attention to the bipolar system.

We have now found that this lack of attention is wholly unmerited. The bipolar system can provide both a higher production rate, being amenable to higher current densities, and a product of perfectly adequate purity, in a somewhat simpler cell array than the Betts Process, as conventionally operated, requires.

In bipolar refining of copper, 1.186 g of copper per A.hr is deposited at 100% current efficiency, and thus preparation of high quality electrodes is very important. Since slimes resulting from the refining do not adhere to the electrode surface, they require additional space to be allocated for their collection in the lower portion of the cell: this limits the obtainable current efficiency for the process. Further, these slimes which accumulate in the bottom of the cell must be removed often. It is standard practice to use relatively high electrolyte temperatures. Electrical edge-effects around the electrodes and the additional space for slime accumulation in the lower portion of the cell require extensive baffling in the cell. It is also necessary to provide means for agitation or forced circulation of the electrolyte in order to assist in mass-transfer of copper. To effect this agitation, means such as bubble tubes and the like are used. Finally, the amount of anode scrap is relatively low. Careful handling of the deposited copper is necessary to avoid contamination with lead from the anode slimes.

In distinction, in bipolar refining of lead, 3.685 g of lead per A.hr is deposited at 100% current efficiency. Cast or rolled electrodes having a relatively smooth surface are satisfactory. The slimes substantially all adhere to the anodic surface of the electrodes and therefore almost no additional space is required in the lower portion of the cell. Consequently, essentially no baffling is necessary. Relatively low temperatures also can be used, and no special agitation or forced circulation means for electrolyte within the cell is required as mass-transfer of lead is rapid and can be readily attained by natural convection assisted by the usual procedures for feeding and discharging electrolyte. Also, programmed current-voltage relationships can be used during electrolysis, to optimise cell performance. The amount of undissolved electrode at the end of refining cycle is relatively high in order to provide surface for attachment of slimes, rigidity for removal of the slimes, and rigidity for removal of the deposited lead. As the slimes essentially remain on the electrodes, slimes removal is carried out away from the electrolytic cell.

The process of the present invention has many advantages over the conventional multiple system of the Betts Process. Only one type of electrode is required and has, therefore, to be prepared and handled. The bipolar electrodes are sufficiently rigid to allow accurate mechanized setting and pulling, and close spacing of the electrodes is possible without experiencing effects of distortion caused by the use of the initially thin cathodes used in the conventional Betts Process. Spacing of the electrodes away from the cell walls can be reduced if not actually eliminated when suitable electrolyte circulation is also used. Electrical contacts are required only at each end of a cell which, eliminates the use of heavy copper bus bars along the cell sides.

Smaller power supply units can be used because of the lower currents required which make it possible to use a multiplicity of electrical circuits each connected to one or more cells. Consequently each cell or group of cells can be separately programmed to operate at the optimum current-voltage relationships. As only end electrodes in each cell are connected to the electrical power source, and the intermediate bipolar electrodes are not (except through the electrolyte), no elaborate design to ensure proper electrical contact between electrodes and special contact bars is necessary. Elimination of individual electrical contacts to heavy copper bus bars reduces the total electrical resistances resulting in increased power efficiency and reduced power costs. No recycle of lead is required to produce lead cathode starting sheets. Cells and electrodes can be much larger resulting in less floor space for a given refinery capacity. Higher current densities are possible as a result of eliminating separate sheet cathodes, bus bars and contact bars. Any shorting in the cells between electrodes causes only a loss of current efficiency of the shorted electrodes and not of the whole cell. Elimination of bus bars and individual electrical electrode contacts obviate inspections for poor contacts, and enables the use of closed cells. Cell closure permits much improved hygienic conditions. Hygienic conditions for the process operators are further improved as the need for operators to spend time in the vicinity of the cells is substantially reduced.

Thus the present invention seeks to provide a method and apparatus for the bipolar electrolytic refining of lead whereby major improvements are achieved in efficiency and economics compared to the conventional Betts Process.

Thus in a first aspect this invention provides a process for the electrorefining of lead from lead bullion using an aqueous electrolyte containing lead fluosilicate and hydrofluosilicic acid contained in an electrolytic cell, which comprises interposing in the cell between an anode and a cathode one or more electrically unconnected lead bullion bipolar electrodes, allowing electrolysis to proceed to deposit refined lead and recovering said refined lead.

In a second aspect this invention provides a process for the electro-refining of lead from lead bullion which comprises immersing in an aqueous electrolyte containing lead fluosilicate and hydrofluosilicic acid contained in an electrolytic cell at least one anode and at least one cathode, each adapted to be connected to a direct electrical current source; immersing in the electrolyte between the anode(s) and cathode(s) at least one lead bullion bipolar electrode; passing a direct electrical current through the cell causing lead to dissolve from the lead bullion electrode(s) leaving a layer of slimes adhering to the lead bullion electrode(s) and to deposit upon another electrode as refined lead; continuing the passage of current until a deposit of a layer of refined lead is obtained on at least one electrode; removing the electrode(s) carrying the refined lead; and recovering the refined lead.

In a third aspect this invention provides a process for the electro-refining of lead from lead bullion containing bismuth which comprises immersing in an aqueous electrolyte containing lead fluosilicate, hydrofluosilicic acid and addition agents contained in an electrolytic cell at least 3 electrodes including at least one lead bullion electrode; spacing the electrodes in the cell at predetermined fixed intervals; circulating electrolyte through the cell; passing a direct electrical current through the electrolyte and the electrodes causing lead to dissolve from the lead bullion electrode(s) leaving an adhering layer of slimes and depositing refined lead upon another electrode, and passing the electrical current between the first and last of the electrodes in the cell whereby one of said first and last electrodes acts as an anode, the other of the first and last electrodes acts as a cathode, and any lead bullion electrodes between the first and last electrodes acts as bipolar electrode; allowing electrolysis to proceed until a layer of refined lead of desired thickness has been deposited; removing the electrode(s) having the desired thickness of refined lead from the cells; removing any slimes adhering to removed electrode; and recovering the refined lead from the removed electrode.

In a fourth aspect this invention provides an apparatus for electrolytically refining lead comprising a cell having side-walls, end walls, and a bottom having an inner surface of an electrically insulating material that is substantially inert to an electrolyte solution substantially comprising lead fluosilicate and hydrofluosilicic acid; a multiplicity of electrodes located in the cell at predetermined fixed intervals being immersed in the electrolyte, the first and last electrodes in the cell being adapted to have applied to them a direct electrical current, whereby one of said first and last electrodes acts as an anode, the other of said first and last electrodes acts as a cathode and any electrodes between said first and last electrodes act as electrically unconnected bipolar electrodes.

Preferably, the weight of at least the bipolar electrodes is supported substantially from the bottom of the cell. Preferably the anode, or cathode, or both, comprise two adjacent electrodes at an end of the cell, whereby continuous changing of all electrodes over a period of time is possible without interruption of the electrolysis.

In a preferred form of apparatus according to this invention, the bipolar electrodes are supported substantially from the bottom of the cell. These bipolar electrodes are dimensioned so as to provide minimal gaps between their edges and the cell walls, the gap preferably being 0 to 5 cms. The circulated electrolyte enters the cell through at least one ingress point along the side of the cell and leaves through at least one egress point along the other side of the cell and thus is caused to flow crosswise through the cell between the bipolar electrodes.

DESCRIPTION OF THE PREFERRED EMBODIMENTS

Electrodes of lead bullion for subsequent electrorefining generally are manufactured from lead bullion obtained from metallurgical treatment of lead-containing ores and concentrates. The lead bullion may contain such metals as bismuth, arsenic, antimony, silver, gold, and tin, as well as small amounts of other metals. Electrodes may be manufactured according to any of a number of methods, which must ensure a crystallographic structure such that slimes substantially adhere to the electrodes during and after electrolysis. Thus, electrodes may be formed by casting molten bullion in electrode moulds which may be part of a casting line or wheel, or the lead bullion may be formed into a continuous strip in a continuous casting machine, and the resulting strip cut to provide the desired electrodes. It is desirable to provide at least a relatively smooth cathodic surface on the electrodes to ensure easy stripping of the deposited lead. Cast electrodes may be rolled, if desired, to the desired thickness, and/or to provide the desired smoothness of surface. Electrodes usually have generally rectangular cross-sections and, if desired, the electrodes may have formed integrally with the portion immersed in the electrolyte suspension means such as, for example, holes, indentations, lugs, or ears, which facilitate handling of the electrodes. These appurtenances may also provide means to suspend the electrodes in the electrolyte in the cell. Alternatively, hanger bars may be provided which may form an integral part of each electrode, or to which the electrode may be separately attached. The portion of the electrode which is to be immersed in electrolyte may have almost any shape but is preferably of substantially rectangular shape. The dimensions of the electrodes are determined by the dimensions of the cell, the desired values of operating parameters and the characteristics of the electrode handling devices. Electrodes measuring as large as 2 by 3 meters and up to about 3 cm thick may be used. The number of electrodes in a cell is limited by the electrical insulative capacity of the cells, which also determines the maximum cell voltage. For example, a well insulated cell may be operated at a 500 V potential and contain 500 to 1000 electrodes, each having a surface area of 2 to 6 $m^2$ (square meter).

The first and the last electrodes in the cell which are connected with the source of direct current act as an anode and a cathode, respectively. The first and last electrodes may have the same composition and dimensions as the intermediate bipolar electrodes, which simplifies the process as it requires the handling of only one type of electrode. In this case, no special handling or preparation of the first and last electrode is required. Alternatively, the first electrode or anode may be an electrode similar to the bipolar electrode and the last electrode or cathode may be a thin sheet of electrorefined lead or a sheet of other material which is non-corrosive in the electrolyte and on which lead can be deposited. If desired, the cathodic side of the first electrode and the anodic side of the last electrode may be masked with a suitable material. Alternatively, inert end electrodes may be used, which function as the anode and the cathode.

The connection of the first and last electrodes with the source of direct current may be by contact means such as clamps or small copper bus bars each in contact with the first and last electrodes.

In one preferred embodiment of the invention, the first two electrodes and the last two electrodes in the cell are connected as a pair of anodes or cathodes to the electrical power source. This enables continuous operation of the cell. When all electrodes are in the cell the first electrode and the last electrode act as anode or cathode respectively, while the second electrode and the second to last electrode act partly as bipolar electrodes. Upon changing electrodes by pulling alternate electrodes from the cell one of the first two and one of the last two electrodes will remain in the cell ensuring uninterrupted supply of power to the cell. When only one of the first two electrodes remains, the remaining electrode acts as anode and, similarly, when only one of the last two electrodes remains, the remaining electrode acts as a cathode.

The cathodic side of the electrodes should be covered with a parting agent before immersion in the electrolyte to facilitate the stripping of the electrodeposited lead from the electrodes on their removal from the cell. A suitable parting agent is one which can be thinly, easily and evenly applied to the electrode surface, will not attack lead or affect the purity of electrodeposited lead, will not dissolve in electrolyte or affect the deposition process, is reasonably electrically conductive and is readily and economically available. Suitable parting agents include oils, lacquers, acrylic materials, rosins and resinates. The parting agent may be applied as a solution by painting, brushing, rolling, dipping, or spraying. Satisfactory results have been obtained by applying sodium resinate dissolved in methanol. The amount of parting agent on the electrode should be such that electrodeposited lead can be readily removed by mechanical means, but conversely such that the deposited lead does not part prematurely. Suitable removal characteristics have been obtained using a solution of sodium resinate or rosin in methanol applied in an amount equivalent to 300 to 500 g resinate or rosin per ton of refined lead.

The electrolytic cells used in the process are vessels with generally rectangular cross-sections made of steel or concrete and lined with a suitable electrically non-conductive material substantially inert to electrolyte, such as rubber-based or synthetic polymeric materials, or bituminous materials such as asphalt. The cells are equipped with means for feeding and discharging electrolyte. The means for feeding and discharging electrolyte may be positioned at opposite ends of the cell or along the sides of the cell depending on the desired direction of electrolyte flow. The direction of electrolyte flow may be length-wise or cross-wise relative to the electrodes. Electrolyte may be fed and discharged at one or more points along the respective ends or sides of the cell or along the full length of the respective ends or sides. Electrolyte flows through the cell and is allowed to overflow from ends or sides of the cell or along the full length of the respective ends or sides. Electrolyte flows through the cell and is allowed to overflow from the cell. The overflow may comprise a baffle extending partly downwardly into the cell which prevents short-circuiting of electrolyte between feed and discharge and whereby the discharging electrolyte is forced to come from the bottom portion of the cell. No special forced agitation or circulation of electrolyte is necessary as natural convection due to concentration gradients caused by electrolysis and normal feeding and discharging of electrolyte, as well as the rapid mass transfer rate of lead, ensure fast, unhindered deposition of lead. No baffling is required in the cell to reduce current flow around the side and bottom edges of the electrodes when the electrodes are closely surrounded by the walls of the cell. However, if desired, the effect of current flow around edges of the electrodes may be reduced by the use of edge-sticks mounted on at least a portion of electrode edges. Such edge-sticks can also be designed so as to facilitate stripping of the electrode-deposited lead.

When the electrodes are placed in the cell, the suspension means for the electrodes can rest on the top of the side-walls of the cell. The suspension means may rest directly on the side-walls or may rest on an upward extension of the side-walls, which may be rounded or tapered in such a way that the electrodes upon placing in the cell are directed towards the centre of the cell whereby possible scouring of the cell walls by the electrodes during handling is substantially avoided.

In a preferred embodiment of the invention large size electrodes having surface areas larger than about 2 $m^2$ are used. The weight of such electrodes makes the use of suspension means impracticable and it is necessary to support the electrodes substantially from the bottom of the cell. Bottom supports of a suitable insulating material are used which may form an integral part of the cell, or may be placed on the bottom of the cell. Bottom supports are designed in such a way that substantially the full weight of the electrodes is supported by the bottom supports, and thus, in turn, by the bottom of the cell. The supports may be length-wise bottom supports which extend the length of the cell and may be of rectangular cross-section. Two or more length-wise bottom supports may be used for a row of electrodes. To provide spacing of the electrodes, the length-wise bottom supports may be provided with indentations such as grooves or notches of suitable cross section which can be rectangular, rounded, or V-shaped. The indentations are spaced along the length of the length-wise supports at identical intervals to provide the predetermined spacing of the electrodes as well as support for the electrodes. Preferably, bottom supports comprise a lattice consisting of two or more parallel length-wise supports and a plurality of cross-supports. Cross-supports are positioned parallel to, and directly underneath, each electrode. In the case of using indentations in the length-wise supports the height of each cross-support measured from the surface of the bottom of the cell is equal to the height of the bottom of the indentation in the length-wise supports.

The spacing of the electrodes in the cell may be further determined by the use of side and/or top spacers located at the top portion of the cell and extending the length of the cell. These spacers are shaped similarly to the length-wise bottom supports with indentations. Top spacers may be located on each cell wall perpendicular to the electrode edges, or may extend downwardly into the cell along those walls, or both. Alternatively, top spacers may be used on top of the electrodes. The indentations in the bottom and side supports are aligned such that the centres of an indentation in each of the length-wise bottom supports and side and/or top spacers are located in the same cross-sectional plane of the cell.

In the case of top spacers being located at the walls of the cell, the spacers may be attached to the cell or form an integral part therewith. In the case of top spacers being used on top of the electrodes, two or more parallel spacers may be used in an inverted manner, which are placed in position preferably prior to or during the placing of the electrodes in the cell.

Thus it can be seen that the electrode support system needs to be such as will stably locate the electrodes in the cell and maintain them in a desired position during electrolysis. A combination of bottom supports and suspension means for the electrodes may also be used.

The cell and electrodes are designed such that the spacing between electrodes and between the sides of the electrodes and the walls and the bottom of the cell is as small as feasibly possible. The electrodes can be spaced from each other at as small a distance as about 2 cm face to face from each other, but a more practical spacing is susually in the range of 2 to 5 cm. The spacing between the vertical and bottom sides of the electrodes and the wall and bottom of the cells, respectively, may be maintained at less than about 5 cm, and preferably in the range of 0 to 5 cm. Preferably this gap is zero, but adequate cell performance is attained if the gap is in the range of 0 to about 3 cms.

The process of the invention can be extensively mechanized. Lead bullion electrodes are manufactured in a casting wheel or a continuous strip casting machine and formed in the desired shape and size. The cathodic side of the electrodes is mechanically covered with a suitable amount of parting agent and the electrodes are mechanically arranged in a lifting rack suspended from a crane which can move back and forth over the electrolytic cells. The arrangement of the electrodes in the rack is such that upon placing in the cell, the desired spacing of the electrodes in the cells is automatically obtained.

The cells may be supplied with suitable covers. Covers eliminate contamination of the air in the refinery with fluorides, and thereby much improve the hygienic conditions in the refinery. Covers do not interfere with the operation of the process, as the use of contact bars, bus bars and individual electrical electrode contacts is eliminated making frequent inspections of the cells unnecessary. Covers of a suitable form can be made in one or more sections or parts to cover the top of the cells. Covers are placed on the cells at the beginning of a refining cycle after the electrodes have been placed in the cells, remain on the cell for the duration of the cycle and are removed just before electrodes are to be removed from the cell. The crane accurately places the electrodes in the cells. After completion of the electrolysis the crane lifts the electrodes, or a desired portion thereof, from the cell and deposits the electrodes at the stripping machine for removal of slimes, removal of electrolyte, if desired, and recovery of the electrodedosited lead. The stripping machine is constructed in such a manner that one or more electrodes are conveyed through the machine wherein the slimes adhering to the anodic side of the electrodes are removed and the electrodeposited lead is separated from the remaining portion of the electrodes and recovered. If desired, electrolyte may be washed from the electrodes using sprays of water or steam or mixtures thereof. The recovered sheets of electrodeposited refined lead are subsequently melted and cast into shapes for sale. The remaining portions of the bullion electrodes are subsequently remelted and formed into new electrodes for return to the electrolysis process. Slimes are washed to remove electrolyte and treated for recovery of metal values therein, such as silver, bismuth, arsenic, antimony, tin and gold.

The electrolyte is an aqueous solution of hydrofluocilicic acid, and lead fluosilicate, and contains addition agents for grain refining and levelling of deposited lead. The composition of the electrolyte varies and may, for example, contain about 70 g/l lead as lead fluosilicate, about 90 g/l hydrofluosilicic acid, from about 250 to about 450 g lignin sulfonate per ton of deposited lead as grain refining agent and from 130 to 230 g Aloes extract per ton of deposited lead as levelling agent. It is understood that other compositions of electrolyte and other addition agents to obtain the desired effects may be used.

The temperature of the electrolyte is maintained in the range of 20° to 45° C., preferably in the range of about 35° C. to about 40° C. Below about 35° C. insufficient evaporation occurs to maintain the desired water balance in the process unless special evaporative techniques are used, while above about 45° C. control of hygienic conditions as well as corrosion of materials by acidic cell fumes becomes severe.

The potential gradient between two adjacent bipolar electrodes (centre to centre) may be maintained at a value in the range of about 0.2 to 1.5 V. This potential gradient consists of the potential gradient over the electrolyte, the anodic over-potential and the cathodic over-potential. The anodic over-potential is kept to less than the value at which bismuth dissolves, i.e. the critical anode over-potential, which varies with the composition of the lead bullion and usually has a value of about 0.2 V.

As the anodic over-potential increases during electrolysis due to the increasing thickness and correspondingly increasing resistance of the slime layer, the electrolysis would normally be halted, i.e. the electrodes removed from the cell, before the anodic over-potential reaches its critical value. Alternatively, the current could be decreased as will be discussed herein below. The cathodic over-potential, or cathode polarization voltage, should be monitored during electrolysis and controlled at optimum values by altering the effectiveness of the addition agents. The procedure and apparatus required to achieve this are described in detail in Canadian Pat. No. 988,879, issued May 11th, 1976. A summary of this procedure is as follows.

The cathodic over-potential is maintained at values, expressed as the slope of the cathodic over-potential voltage versus current density curve in the range of about 0.3 to about 0.5 mV/A/m$^2$, preferably about 0.37 mV/A/m$^2$. Thus, at current densities in the range of 100 to 600 A/m$^2$, the cathodic over-potential should be controlled at values in the range of 30 to 300 mV. The effectiveness of the addition agents may be altered by altering the concentration of agents in, or the rate of addition of agents to, the electrolyte, or by addition of a suitable thiosulfate control agent.

The effectiveness of addition agents is altered by the addition of a thiosulfate control agent to the electrolyte when the cathode polarization voltage rises above values at which the value of the slope of the cathode polarization voltage versus current density curve exceeds about 0.5 mV/A/m$^2$. The thiosulphate control agent is preferably chosen from the group of alkali metal thiosulfates, ammonium thiosulfate, calcium thiosulfate and lead thiosulphate.

The current densities in the process of the invention can be as high as 600 A/m$^2$ and are usually in the range of 100 to 600 A/m$^2$ preferably 250 to 500 A/m$^2$. These current densities are considerably higher than those in the conventional Betts Process which operates at current densities of less than about 200 A/m$^2$.

Current and voltage supplied to the process in a programmed fashion can be used to great advantage. In the conventional Betts Process, the use of programmed current and voltage is limited by the size of the bus bars and current carrying capacity of the cathodes. High current densities, i.e. above about 300 A/m$^2$, require cathodes that are at least twice as thick and bus bars that have three times the cross-sectional area of those used at lower current densities, i.e. about 200 A/m$^2$ and less. High cell currents applied with conventional size cathodes and bus bars lead to excessive heat generation resulting in waste of energy and heating of the electrolyte to above values that are acceptable to ensure hygienic conditions. As no bus bars, electrical contacts (except at the anode and cathode) or multiplicity of separate sheet cathodes are used in the bipolar refining process, and only relatively low cell currents are used, high electrode current densities above 300 A/m$^2$ can be utilized without excessive heat generation and accompanying unacceptable hygienic conditions.

In using a programmed current and voltage supply system, the current supplied to each cell may be varied during the electrolysis in relation to the internal resistance of the cell and, similarly, the anode voltage may be varied as long as the anode voltage during electrolysis does not reach or increase above the critical value at which bismuth dissolves (the anodie overpotential). Such a procedure is described in more detail in Canadian Patent 1,020,491 issued November 8th, 1977. In accordance with this procedure, the anode voltage may be established at the beginning of the refining process at a value below the critical value and the current is increased to its maximum value allowable in relation to the cell resistance. The current is gradually decreased from its initial maximum allowable value to allow, at all times, for the effects of the increasing thickness, and hence increasing resistance, of the slime layer, whereby to ensure that the critical value for the anodic over-potential is not exceeded. The process may be operated at a constant cell potential giving values for the anodic over-potential just below the critical value by controlling the current which passes through the cells at maximum allowable decreasing values. This results in a reduction of the duration of the refining process to its minimum value. Alternatively, the process may be operated with a cell potential giving anodic over-potential values further below its critical value, allowing the anode voltage to increase to its critical value during electrolysis and with currents at values below the maximum values allowable, which results in a proportional increase in the duration of the refining process. Thus, while the number of ampere-hours remains constant for the deposition of a given amount of lead, the duration of the refining process varies correspondingly to the electrical current applied to the cell. Periodic changing of electrodes in the cell is possible by maintaining the cell current below the maximum allowable value, for example, at a constant or decreasing value for the duration of the changing.

EXAMPLE 1

Lead bullion electrodes, 2 cm thick, were manufactured by casting. Lugs for suspension of the electrodes in the electrolytic cell were cast integrally with the electrodes. One side of the electrodes, the cathodic side, was covered with a layer of sodium resinate which was brushed on in a methanol solution containing 100 g resinate per liter. 24 electrodes were suspended in an electrolytic cell measuring 78×270×112 cm. The electrodes were immersed in electrolyte, the submerged area measuring 66×90 cm, at a spacing between electrode centres of 5 cm. The spacing between the sides and bottom edges of the electrodes and the side-walls and bottom of the cell was 5 cm.

Electrolyte containing 87 g/l fluosilicic acid, 80 g/l lead as lead-fluosilicate, 4 g/l lignin sulfonate and 2 g/l Aloes extract was continuously fed into one end of the cell normal to the electrodes and continuously discharged via a baffled overflow discharge at the opposite end of the cell at a rate of 27 l/min. No special circulation or agitation means for the electrolyte were used. The temperature of the electrolyte was 43° C. The first and last electrodes in the cell were connected to a direct current power supply and electrolysis was conducted for a period of 150 hours at a cell current of 95 A, giving a current density of 160 A/m$^2$ and a cell voltage of 13.5 V for an anode over-potential of just below 0.2 V. The potential drop between two electrodes was 0.52 V. The cathode polarization voltage was monitored during the process and maintained at 80 mV.

After completion of the electrolysis, the current supply was interrupted and the electrodes were lifted from the cell. The slimes had remained on the anodic surface in an adherent layer which has easily removed. After washing electrolyte from the electrodes, the cathodic deposit of lead, which was smooth and even without growths on the surface or at the edges, was easily separated from the remaining portion of the electrodes. The refined lead was 99.99% pure and contained between 8 and 13 ppm bismuth. The current efficiency was calculated at 83%.

EXAMPLE 2

This example illustrates the effect of spacing between electrode edges and cell walls on the current efficiency of electrolysis.

Using the method of the invention lead bullion electrodes were subjected to electrolysis for 7 days at a current density of 200 A/m$^2$ in an electrolyte containing 70 g/l lead as lead fluosilicate, 95 g/l fluosilicic acid, 1.5 g/l Aloes extract and 4 g/l lignosulfonate. A direct electrical current was applied between the first and last electrodes; the electrodes between these and electrodes acted as bipolar electrodes. The temperature was maintained at 40° C. during the electrolysis. The electrodes size and the cross-sectional area of the cell was varied from test to test, the ratio of electrode to cell area determined and the current efficiency calculated at the end of each test. Test results are given in Table I.

Table I

| test No. | number of electrodes | electrode area in cm$^2$ | cross-sectional cell area in cm$^2$ | ratio electrode to cell area | current efficiency in % (bipolar electrodes) |
|---|---|---|---|---|---|
| 1 | 10 | 140 | 217.5 | 0.66 | 55 |
| 2 | 5 | 185 | 217.5 | 0.85 | 81 |
| 3 | 5 | 152 | 217.5 | 0.70 | 61 |
| 4 | 5 | 279 | 490 | 0.57 | 41 |
| 5 | 5 | 333 | 490 | 0.68 | 55 |
| 6 | 5 | 402 | 490 | 0.82 | 74 |
| 7 | 3 | 185 | 185 | 1.00 | 100 |
| 8 | 24 | 5940 | 8661 | 0.69 | 52 |
| 9 | 24 | 5940 | 6750 | 0.88 | 83 |

It is evident from the tabulated test results that the current efficiency increases in an almost linear fashion with an increasing ratio of electrode area to cross-sectional area of the cell, i.e. with decreasing space around the electrode edges.

EXAMPLE 3

Using bipolar refining of lead according to the method of the invention, a series of tests was run at increased current densities. Electrolysis was carried out for a four day period using lead bullion electrodes placed in a cell containing an electrolyte which contained 70 g/l lead as lead-fluosilicate, 95 g/l fluosilicic acid, 4 g/l lignin sulfonate and 1.5 g/l Aloes extract. A temperature of 40° C. was maintained. The current, and the corresponding electrode current density, was programmed to decrease in relation to the internal resistance of the cell in such a manner that the anodic overpotential did not exceed the critical value of 0.2 V at which bismuth starts to dissolve. At the end of the four day electrolysis period, the cathodically deposited lead was analyzed. The current densities and lead analyses for each test are given in Table II.

Table II

| test number | current density in A/m$^2$ day 0 | 1 | 2 | 3 | 4 | lead produced in kg/m$^2$* | lead analyses in % Bi | Ag | Sb | As |
|---|---|---|---|---|---|---|---|---|---|---|
| 1 | 215 | 215 | 215 | 215 | 215 | 109.2 | 0.0001 | 0.00003 | 0.0025 | 0.001 |
| 2 | 310 | 310 | 310 | 310 | 310 | 159.8 | 0.0001 | 0.00003 | 0.0009 | 0.001 |
| 3 | 375 | 375 | 375 | 375 | 375 | 191.2 | 0.0001 | 0.00003 | 0.0010 | 0.001 |
| 4 | 464 | 464 | 464 | 464 | 404 | 226.5 | 0.0007 | 0.00020 | 0.0010 | 0.001 |
| 5 | 593 | 593 | 593 | 522 | 484 | 266.1 | 0.0001 | 0.00010 | 0.0005 | 0.001 |

*kg per m$^2$ of electrode surface

These tests demonstrate that the process of the invention can be operated at current densities as high as 600 $A/m^2$ and still produce electrorefined lead which is 99.99% pure.

The cathode polarization voltage (c.p.v.) was controlled at values corresponding to values of the slope of the c.p.v. versus current density curve in the range of 0.33–0.39 $mV/A/m^2$, by making the requisite additive additions.

The c.p.v. was monitored by placing a sample of electrolyte in a monitoring cell containing lead electrodes, applying an electrical current between the electrodes and measuring the c.p.v. between the cathode and a Luggin probe in contact with the cathode. The calculated target c.p.v., the measured c.p.v. after adjusting the amounts of addition agents as necessary and the measured voltage between electrodes for test number 5 of Table II are shown in Table III.

Table III

| day | current density in $A/m^2$ | calculated c.p.v. in mV | measured c.p.v. in mV | measured voltage between electrodes in mV |
|---|---|---|---|---|
| 0 | 593 | 196–219 | 204 | 610 |
| 1 | 593 | 196–219 | 200 | 650 |
| 2 | 593 | 196–219 | 200 | 700 |
| 3 | 522 | 173–204 | 184 | 700 |
| 4 | 484 | 160–188 | 187 | 700 |

As can be seen from the data presented in Table III, the measured values of the c.p.v. were in the ranges of the desired (calculated) values.

The test results also show that the process can be operated successfully when the c.p.v. is monitored and controlled, and when the initial current and corresponding current densities are raised to a very high level and are decreased during the electrolysis in relation to the internal resistance of the cell.

What I claim as my invention is:

1. A process for the electrorefining of lead from lead bullion using an aqueous electrolyte containing lead fluosilicate and hydrofluosilicic acid contained in an electrolytic cell, which comprises interposing in the cell between an anode and a cathode one or more electrically unconnected lead bullion bipolar electrodes, allowing electrolysis to proceed to deposit refined lead and recovering said refined lead.

2. A process according to claim 1 wherein either the anode, or the cathode, or both anode and cathode comprise two adjacent electrodes at an end of the cell.

3. A process for the electrorefining of lead from lead bullion which comprises immersing in an aqueous electrolyte containing lead fluosilicate and hydrofluosilicic acid contained in an electrolytic cell at least one anode and at least one cathode, each adapted to be connected to a direct electrical current source; immersing in the electrolyte between the anode(s) and cathode(s) at least one lead bullion bipolar electrode; passing a direct electrical current through the cell causing lead to dissolve from the lead bullion electrode(s) leaving a layer of slimes adhering to the lead bullion electrode(s) and to deposit upon another electrode as refined lead; continuing the passage of current until a deposit of a layer of refined lead is obtained on at least one electrode; removing the electrode(s) carrying the refined lead; and recovering the refined lead.

4. A process for the electrorefining of lead from lead bullion containing bismuth which comprises immersing in an aqueous electrolyte containing lead fluosilicate, hydrofluosilicic acid and addition agents contained in an electrolytic cell at least 3 electrodes including at least one lead bullion electrode; spacing the electrodes in the cell at predetermined fixed intervals; circulating electrolyte through the cell; passing a direct electrical current through the electrolyte and the electrodes causing lead to dissolve from the lead bullion electrode(s) leaving an adhering layer of slimes and depositing refined lead upon another electrode, and passing the electrical current between the first and last of the electrodes in the cell whereby one of said first and last electrodes acts as an anode, the other of the first and last electrodes acts as a cathode, and any lead bullion electrode between the first and last electrodes acts as a bipolar electrode; allowing electrolysis to proceed until a layer of refined lead of desired thickness has been deposited; removing the electrode(s) having the desired thickness of refined lead from the cells; removing any slimes adhering to removed electrode; and recovering the refined lead from the removed electrode.

5. A process for the electrolytic refining of lead containing bismuth according to claim 4 which comprises the further step of maintaining the anodic voltage below the voltage at which bismuth dissolves and maintaining the electrical current at a value related to the internal resistance of the cell which will not cause the anodic voltage to rise above the voltage at which bismuth dissolves.

6. A process according to claim 5 wherein the anodic voltage is maintained at a value just below the voltage at which bismuth dissolves.

7. A process according to claim 6 wherein the electrical current is maintained at a constant value for an initial portion of the refining process, and is then maintained at a value less than said constant value, which value is the maximum possible value related to the change of cell internal resistance for the remaining portion of the refining process.

8. A process according to claim 5 or 6 wherein the electrical current is maintained at the maximum value possible related to the change of cell internal resistance with time.

9. A process according to claim 5 wherein the electrical current is maintained at a value lower than the maximum possible value related to the change of cell internal resistance with time.

10. A process according to claim 5 wherein the electrical current is maintained at a constant value during a portion of the refining process.

11. A process according to claim 5 wherein the electrical current is maintained at a constant value during a portion of the refining process whilst changing electrodes.

12. A process according to claim 5 wherein the electrical current is maintained at a constant value during the portion of the refining process required for periodic changing of the electrodes, and wherein the electrical current is maintained at the maximum possible value related to the change of cell internal resistance for the remainder of the refining process.

13. A process according to claim 4 which includes the further steps of directing a minor portion of the circulating electrolyte through a monitoring cell containing a moving lead cathode; measuring the polarization voltage at said cathode; maintaining the slope of the cathode polarization voltage versus current density curve in the range of from about 0.3 to 0.5 millivolts per Ampere per square meter, and altering the effectiveness of said addition agents to obtain a return to a preselected optimum cathode polarization voltage in the cell whenever a change in polarization voltage is detected by said measurement.

14. A process according to claim 13 wherein the process is conducted at a current density in the range of from 100 to 600 Amperes per square meter of electrode surface, and wherein the slope of the cathode polarization voltage versus current density curve is maintained at about 0.37 millivolts per Ampere per square meter.

15. A process according to claim 12, 13 or 14 wherein the effectiveness of said addition agents is altered by altering the concentration of addition agents in the electrolyte.

16. A process according to claim 12, 13 or 14 wherein the effectiveness of said addition agents is altered by altering the rate of addition of the addition agents to the electrolyte.

17. A process according to claim 12, 13 or 14 wherein the effectiveness of said addition agents is altered by the addition of a thiosulfate control agent.

18. A process according to claim 12, 13 or 14 wherein the effectiveness of said addition agents is altered by the addition of a thiosulfate control agent, and wherein said thiosulfate is chosen from the group comprising the alkali-metal thiosulfates, ammonium thiosulfate, calcium thiosulfate and lead thiosulfate.

19. A process according to claim 12, 13 or 14 wherein the effectiveness of said addition agents is altered by the addition of a thiosulfate control agent to the electrolyte when the cathode polarization voltage rises above values at which the value of the slope of the cathode polarization voltage versus current density curve exceeds above 0.5 $mV/A/m^2$.

20. A process according to claim 12, 13 or 14 wherein the effectiveness of said addition agents is altered by the addition of a thiosulfate control agent, wherein said thiosulfate is chosen from the group comprising the alkali-metal thiosulfates, ammonium thiosulfate, calcium thiosulfate and lead thiosulfate, and wherein the thiosulfate is added to the electrolyte when the cathode polarization voltage rises above values at which the value of the slope of the cathode polarization voltage versus current density curve of about 0.5 $mV/A/m^2$ is exceeded.

21. A process according to claim 20, 13 or 19 wherein the addition agents comprise lignin sulfonate and Aloes extract added in an amount of from about 250 to about 450 g pound of lignin sulfonate per ton of lead deposited and of from 130 to 230 g pound of Aloes extract per ton of lead deposited.

22. A process according to claim 4 which includes the further steps of directing a minor portion of the circulating electrolyte through a monitoring cell containing a moving lead cathode; measuring the polarization voltage at the cathode; and altering the effectiveness of the addition agents to obtain a return to a preselected optimum cathode polarization voltage in the cell whenever a change in polarization voltage is detected by said measurement.

23. A process according to claim 4 which includes the further steps of continuously removing a minor portion of the circulating electrolyte; directing said minor portion of electrolyte through a monitoring cell containing a moving lead cathode at least partly submerged in the minor portion; returning said minor portion to said circulating electrolyte; measuring the polarization voltage at said moving lead cathode; generating a signal representing the deviation of the measured cathode polarization voltage from a predetermined reference voltage and controlling a factor that influences the electrolysis of said circulating electrolyte in response to said deviation signal.

24. A process according to claim 23 wherein said factor is the increasing cathode polarization voltage in the circulating electrolyte of the electrolytic process.

25. A process according to claim 23 wherein said factor is the concentrations of the addition agents in the electrolyte.

26. A process according to claim 23 wherein said factor is the rates of addition of the addition agents of the electrolyte.

27. A process according to claim 1, 3, or 4 wherein a suitable parting agent chosen from the group consisting of oils, lacquers, acrylic materials, rosins and resinates is applied to the electrodes to allow removal of the electrodeposit of refined lead.

28. A process according to claim 1, 3, or 4 wherein a parting agent is applied to the electrodes to allow removal of the refined lead, said agent being sodium resinate dissolved in methanol, said agent being applied in an amount of in the range of about 300 to 500 g per ton of refined lead.

29. A process according to claim 1, 3 or 4, wherein the weight of the electrodes is substantially supported from the bottom of the electrolytic cell.

30. A process according to claim 1, 3 or 4, wherein the applied direct electrical current density is in the range of about 100 to about 600 amperes per square meter.

31. A process according to claim 1, 3 or 4 wherein the applied direct electrical current density is in the range of about 250 to 500 amperes per square meter.

32. A process according to claim 1, 3, or 4 wherein electrolyte enters the cell at at least one ingress point along one side of the cell, electrolyte flows cross-wise through the cell between the electrodes and the electrolyte is removed at at least one egress point along the opposite side of the cell.

33. A process according to claim 1, 3, or 4 wherein electrolyte enters the cell at at least one ingress point along one end of the cell, electrolyte flows length-wise through the cell, the overall direction of said flow being substantially at a right angle to the electrodes, and the electrolyte is removed from the cell at at least one egress point at the opposite end of the cell.

34. A process according to claim 1, 3, or 4 wherein only the bipolar electrodes are made of lead bullion.

35. A process according to claim 1, 3, or 4 wherein all the electrodes are lead bullion electrodes, refined lead deposits on one side of the bipolar electrodes and the cathode, and slimes are left adhering to the other side of the bipolar electrodes and to one side of the anode.

36. A process for the electrorefining of lead containing bismuth which comprises the steps of (1) applying a parting agent to at least one side of a multiplicity of lead bullion electrodes;

(2) accurately setting a multiplicity of the lead bullion electrodes having a parting agent upon at least one side thereof at predetermined fixed intervals in an electrolytic cell, said electrodes comprising a cathode, an anode and at least one bipolar electrode;

(3) immersing said electrodes in electrolyte containing lead fluosilicate, hydrofluosilicic acid and addition agents;

(4) circulating the electrolyte through said cell;

(5) substantially supporting the weight of the electrodes from the bottom of the cell;
(6) applying a direct electrical current between said anode and cathode;
(7) maintaining an electrode current density in the range of 100 to 600 $A/m^2$ of electrode surface;
(8) allowing electrolysis to proceed causing a layer of refined lead to be deposited on the one side of the electrodes to which parting agent has been applied and leaving slimes adhering to the other side of the electrodes;
(9) removing electrodes from the cell;
(10) passing removed electrodes to stripping means;
(11) separately stripping refined lead and adhering slimes from the removed electrodes in said stripping means; and
(12) recovering refined lead.

37. A process according to claim 36 which in addition comprises the steps of maintaining the anodic voltage at a value below the voltage at which bismuth dissolves and maintaining the value of the direct current at the maximum value possible related to the change with time of the internal resistance of the cell which will not cause the anodic voltage to rise above the voltage at which bismuth dissolves.

38. A process according to claim 36 or 37 which in addition comprises the steps of directing a minor portion of circulating electrolyte through a monitoring cell containing a moving lead cathode; measuring the polarization voltage at said moving cathode; maintaining the slope of the cathode polarization voltage versus current density curve in the range of from about 0.3 to 0.5 $mV/A/m^2$; and altering the effectiveness of said addition agents by altering at least one of: the concentrations of the addition agents in the electrolyte and the rates of addition of the addition agents to the electrolyte, to obtain a return to a preselected optimum cathode polarization voltage in the electrorefining process whenever a change in cathode polarization voltage is detected by said measurement.

* * * * *